US007431641B2

(12) United States Patent
Darling

(10) Patent No.: US 7,431,641 B2
(45) Date of Patent: Oct. 7, 2008

(54) SYSTEM FOR CONTROLLING DISTRIBUTION OF AIR TO DIFFERENT ZONES IN A FORCED AIR DELIVERY SYSTEM

(75) Inventor: Reyi Darling, Victoria (CA)

(73) Assignee: R.A.D. Innovations, Inc., Victoria (CA)

( * ) Notice: Subject to any disclaimer, the term of this patent is extended or adjusted under 35 U.S.C. 154(b) by 34 days.

(21) Appl. No.: 10/500,570

(22) PCT Filed: Dec. 12, 2001

(86) PCT No.: PCT/CA01/01798

§ 371 (c)(1),
(2), (4) Date: Nov. 3, 2004

(87) PCT Pub. No.: WO03/054454

PCT Pub. Date: Jul. 3, 2003

(65) Prior Publication Data

US 2005/0064812 A1 Mar. 24, 2005

(51) Int. Cl.
*F24F 7/00* (2006.01)

(52) U.S. Cl. ..... 454/333; 454/265; 236/49.3

(58) Field of Classification Search ..... 454/333, 454/334, 332, 265; 236/49.3
See application file for complete search history.

(56) References Cited

U.S. PATENT DOCUMENTS 2,936,692 A * 5/1960 White ..... 454/260
3,830,146 A * 8/1974 Kaiser ..... 454/255
3,898,430 A * 8/1975 Sego et al. ..... 219/453.11
4,210,200 A * 7/1980 Vary ..... 165/98
4,259,896 A * 4/1981 Hayashi et al. ..... 454/120
4,471,758 A * 9/1984 Jennings ..... 126/591
4,690,372 A * 9/1987 Thiebaud ..... 251/129.1
4,879,878 A * 11/1989 Polkinghorne ..... 62/187
4,964,566 A * 10/1990 Pugh et al. ..... 236/49.3
5,833,134 A * 11/1998 Ho et al. ..... 236/49.3
5,863,246 A * 1/1999 Bujak, Jr. ..... 454/255
6,446,876 B1 * 9/2002 Stefano et al. ..... 236/49.3
6,694,759 B1 * 2/2004 Bash et al. ..... 62/180

* cited by examiner

*Primary Examiner*—Derek S. Boles
(74) *Attorney, Agent, or Firm*—Fulwider Patton LLP

(57) ABSTRACT

Apparatus for controlling the delivery of air in a forced air distribution system having a source of air under pressure (4), a duct system to deliver the air, and a plurality of ports (8) in the duct system with each port defining an air delivery zone (16). The apparatus includes a vent member (20) associated with each of the ports which is movable between an open position to admit air to the zone and a closed position to block air from the zone. Independent actuator units (50) are provided to move the vent member between the open and closed positions controlled by a central control system. Thermostats in each air delivery zone communicate with the central control system (80) to control operation of the actuators units and the source of air under pressure which generally comprises heating or cooling equipment such as a furnace or air conditioning unit.

32 Claims, 10 Drawing Sheets

SYSTEM FOR CONTROLLING DISTRIBUTION OF AIR TO DIFFERENT ZONES IN A FORCED AIR DELIVERY SYSTEM

RELATED APPLICATIONS

This is a national phase of International Application No. PCT/CA01/01798, filed 12 Dec. 2001.

FIELD OF THE INVENTION

This invention relates to a system for controlling the distribution of air for heating or cooling to different zones in a forced air delivery system.

BACKGROUND OF THE INVENTION

Forced air distribution systems are commonly used to heat or cool homes. There is generally a furnace to supply heated air or an air conditioning unit to provide cooled air to regions a home via ducts. In many cases, the furnace or air conditioning unit is located in the basement of the home and duct work extends from the basement to terminate at an opening or port in the floor or wall of a room to deliver cooled or heated air to the room. To reduce costs and the complexity of the installation, most forced air distribution systems are controlled by a single thermostat that is centrally located. A user sets the thermostat to a desired temperature which turns on the furnace or air conditioning unit to deliver air through the duct work to the various rooms. When the desired temperature is reached at the thermostat, the furnace or air conditioning unit is switched off by the thermostat. The obvious problem with this arrangement is that while the desired temperature may be reached at the thermostat, this is no guarantee that the desired temperature is reached throughout all the rooms of the home. A single thermostat cannot provide room-by-room temperature control. To address this problem to a limited extent, each port is generally fitted with a register which includes a valve system, often pivotable flaps, that can be set to a particular position to partially control the flow of air into a room. The registers tend to be adjusted to a single position and left as it is a time consuming task to adjust the registers throughout a home.

To combat this problem, the industry has responded with various "multi-zone" climate control systems typically with from 2 to 4 zones per home, each zone controlled by its own thermostat. This system typically adds $2-5,000 to installation costs, and still is only a partial solution. For example, if all the bedrooms of a home are on a single thermostat, the occupants of the other rooms have no individual control of their room's temperature. "Multi-zone" climate control systems are only practical in new construction as they tend to require extensive reworking of the heating and cooling ducts. Retrofitting existing homes can take in excess of 3 weeks to complete.

Electric baseboard heaters are available as a substitute solution, allowing separate control for each room, but, not only are they very expensive to operate, but also slow to heat a room. Retrofitting an existing home with electric baseboard heaters requires upgrading the home's electrical service, and ripping up walls and floors to install the wiring, a costly and time consuming installation. With new construction, these costs are partly avoided, however, the cost of operation, and "slowness" still remain.

Radiant heating, using hot water or electrical elements in walls, floors or ceilings use separate thermostats or controls for each room, but, are also expensive to install and operate, slow to heat required areas, plus require costly control systems. Hot water radiant heating requires a boiler to heat the water, and a complex series of"zone valves" to control the flow of heat where required. Both these systems are installed into floors, walls or ceilings requiring major renovations or new construction to be viable.

Heat pumps use a large refrigeration system "run in reverse" to heat air, and have the added advantage that by "reversing the operation" can be used for air conditioning also. Heat pumps though inexpensive to operate, present an initial installation cost often many times higher than alternate systems. To operate heat pumps for several zones requires a separate heat pump and thermostat for each zone, or installation of the conventional multi-zone systems discussed above, greatly increasing the installation costs.

In view of the foregoing discussion, it is apparent that there is a need for an alternative system for controlling the distribution of air through the existing duct system in a home which is able to control temperature on a room by room zone basis and which is relatively inexpensive to operate and install.

SUMMARY OF THE INVENTION

The present invention provides a system for efficiently controlling the distribution of air through a forced air duct system to individual zones or rooms. Accordingly, the present invention provides apparatus for controlling the delivery of air in a forced air distribution system having a source of air under pressure, at least one duct to deliver the air and at least one port in the duct defining an air delivery zone, comprising:

vent means associated with the at least one port and movable between an open position to admit air to the zone and a closed position to block air from the zone;

actuator means for moving the vent means between the open and closed positions; and temperature sensing means in the air delivery zone in communication with the actuator means to control operation of the actuator means and the source of air under pressure.

The present invention also provides apparatus for controlling the delivery of air in a forced air distribution system having a source of air under pressure, at least one duct to deliver the air and at least one port in the duct defining an air delivery zone, comprising, in combination:

a register unit having a valve associated with the at least one port, the valve being movable between an open position to admit air to the zone and a closed position to block air from the zone;

an actuator unit for moving the valve between the open and closed positions;

a central control system remote from the register unit for controlling the actuator unit; and a thermostat in the air delivery zone for setting a desired temperature in the air delivery zone, the thermostat being in communication with the central control system to control the actuator unit and the source of air supply such that the valve admits air to the zone and blocks air from the zone, in order to achieve said desired temperature.

The system of the present invention is particularly suited for retrofitting into the existing duct work of a home without major renovations to convert a conventional forced air distribution system into one with superior control over air distribution. The system can also be used in new home construction.

The apparatus of the present invention provides room-by-room control of a forced air central heating and/or cooling system. Flow of heating or cooling air is controlled at vent means in the form of heat registers in each room. A thermostat in each room determines the opening and closing of the heat registers in the room, as well as switching on and off of the furnace or AC unit.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
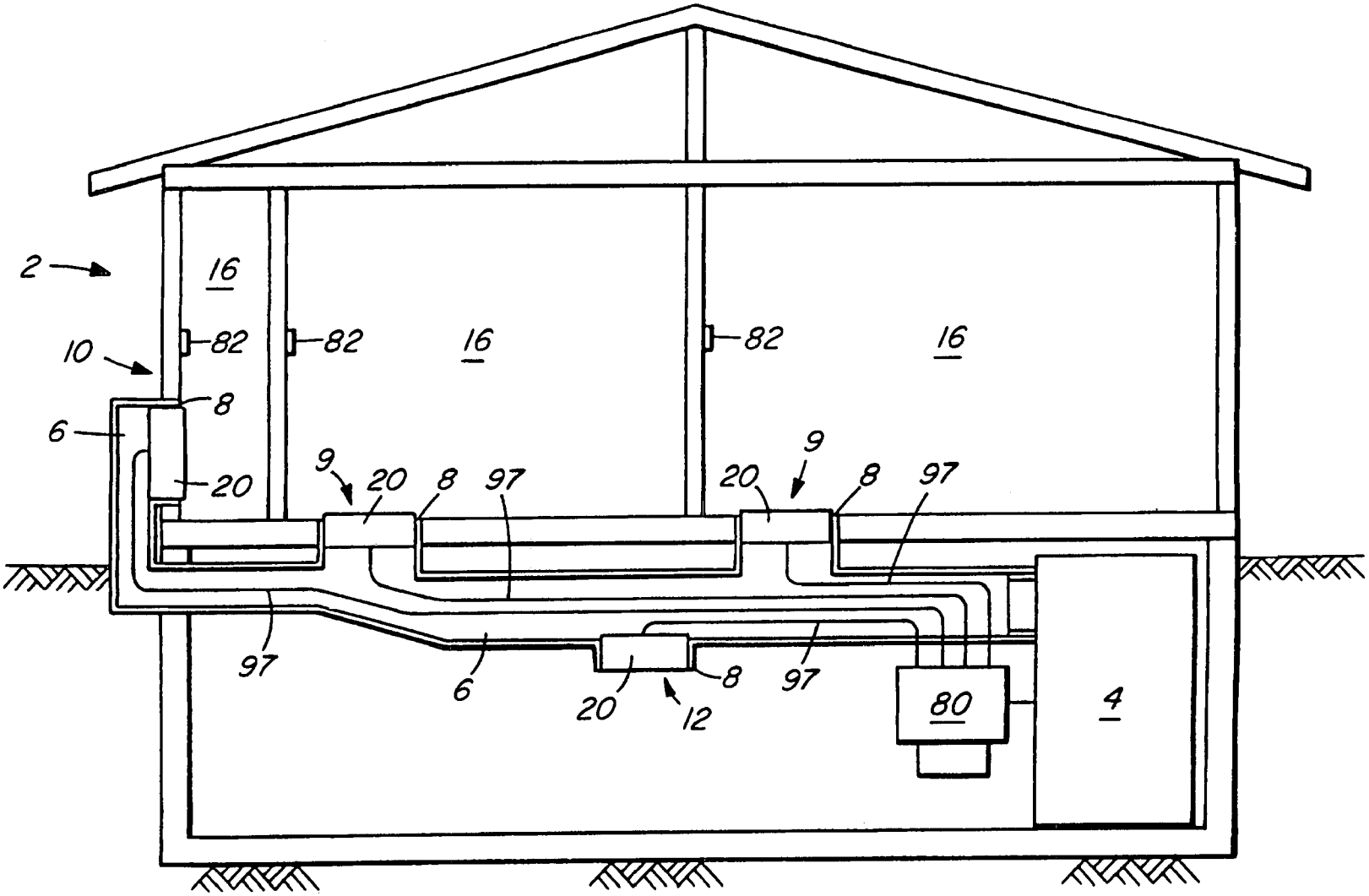
FIG. 1 is a schematic view showing a home heating system fitted with the system of the present invention.

Referring to FIG. 1, there is shown schematically a building 2 incorporating a force air distribution system according to the present invention. Building 2 includes a basement 3 housing a conventional source of air under pressure 4. For the purposes of the following discussion, the source of air under pressure is a furnace 4 providing heated air, but it will be apparent to one of ordinary skill in the art that the pressurized air source can also be an air conditioning unit or the like.

Effectively, furnace 4 with ancillary blower fan (not shown) acts as a supply of pressurized heated air that is delivered to the rest of building 2 via at least one duct 6. Duct 6 is formed with various outlets or ports 8 in the floor 9, walls 10 or ceilings 12 of the buildings. One or more ports 8 can be located in each air delivery zone 16. In the illustrated building, each zone 16 is a separate room having a single port 8 to deliver air, however, this is shown simply for convenience. It will be readily apparent that a single room can include multiple ports 8 which operate independently to divide the room up into multiple zones. Alternatively, multiple ports 8 can be controlled to operate together such that a region is a single air delivery zone. A zone can extend over several rooms. Furnace 4 is shown in the lowermost room or basement of the building, however, the apparatus of the present invention is not limited to such an arrangement. The source of air under pressure 4 can be located anywhere in the building. Vent means in the form of heat registers units 20 are insertable into each port 8 to control the flow of air from duct 6 through the register unit 20 to a particular zone 16. As will be explained in more detail below, each register unit 20 includes a valve arrangement that can be configured between open and closed positions to control the flow of air through the register unit. In the open position of the valve arrangement, each register unit 20 admits air to the associated zone 16, and, in the closed position, the register 20 blocks air leaving the duct into a zone. Intermediate positions of the valve arrangement are possible to permit intermediate air flows, however, the preferred operation of the system of the present invention is to rely on either the open or closed positions of the register units 20.

Figure 2:
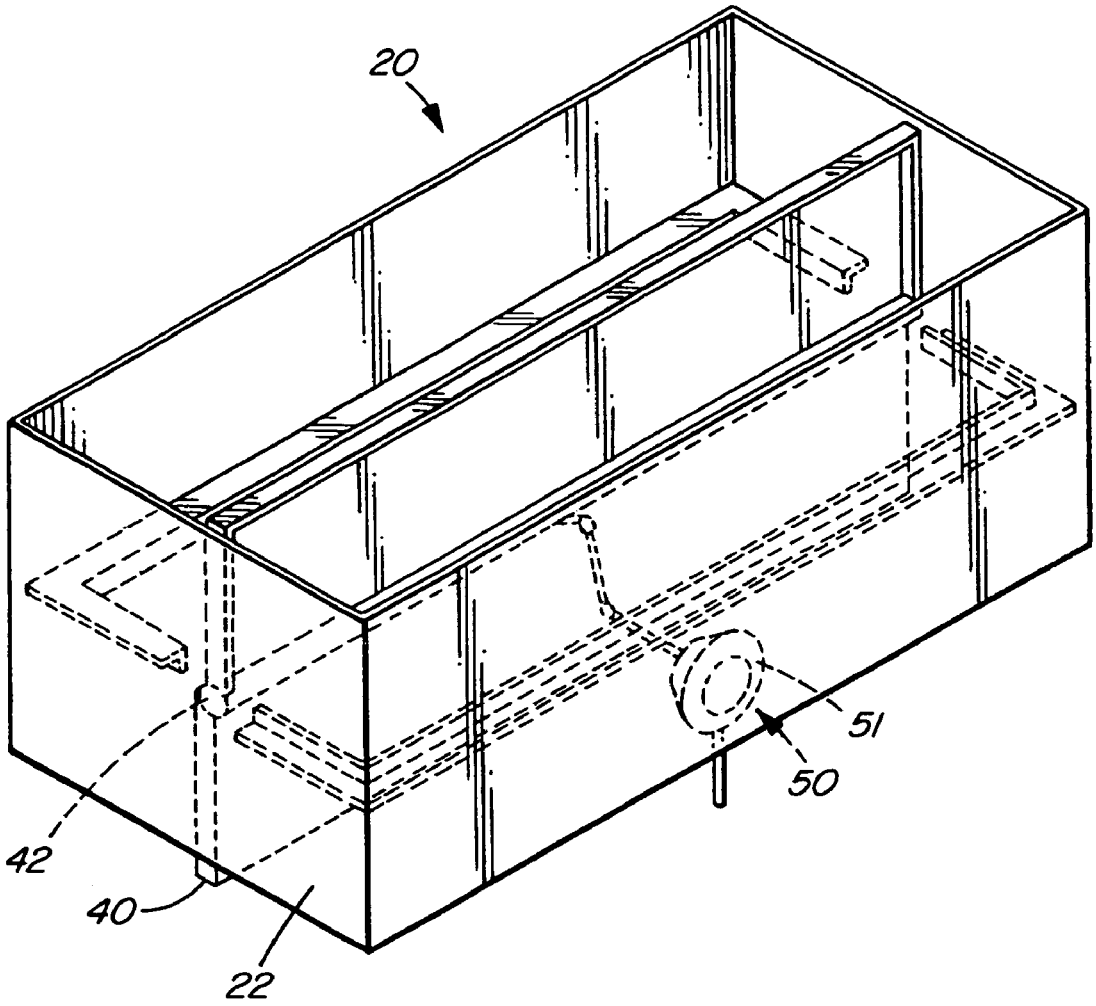
FIG. 2 is a detail view of a register unit insertable into a port of a duct incorporating a pivoting flap valve and an actuator for controlling the flap valve according to one embodiment of the present invention.
Figure 3:
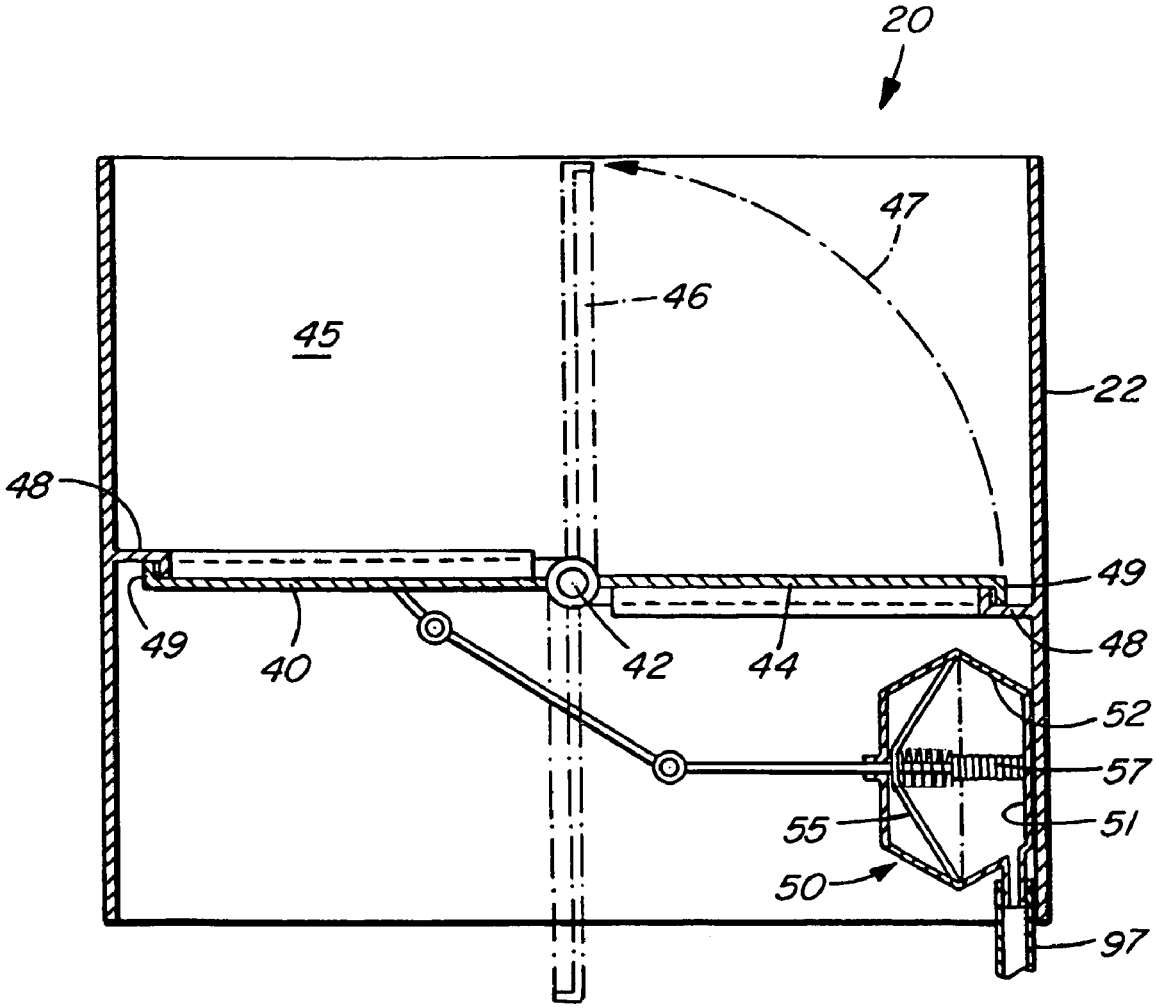
FIG. 3 is a section view through the flap valve and actuator of FIG. 2 showing the operation of the flap valve.
Figure 3A:
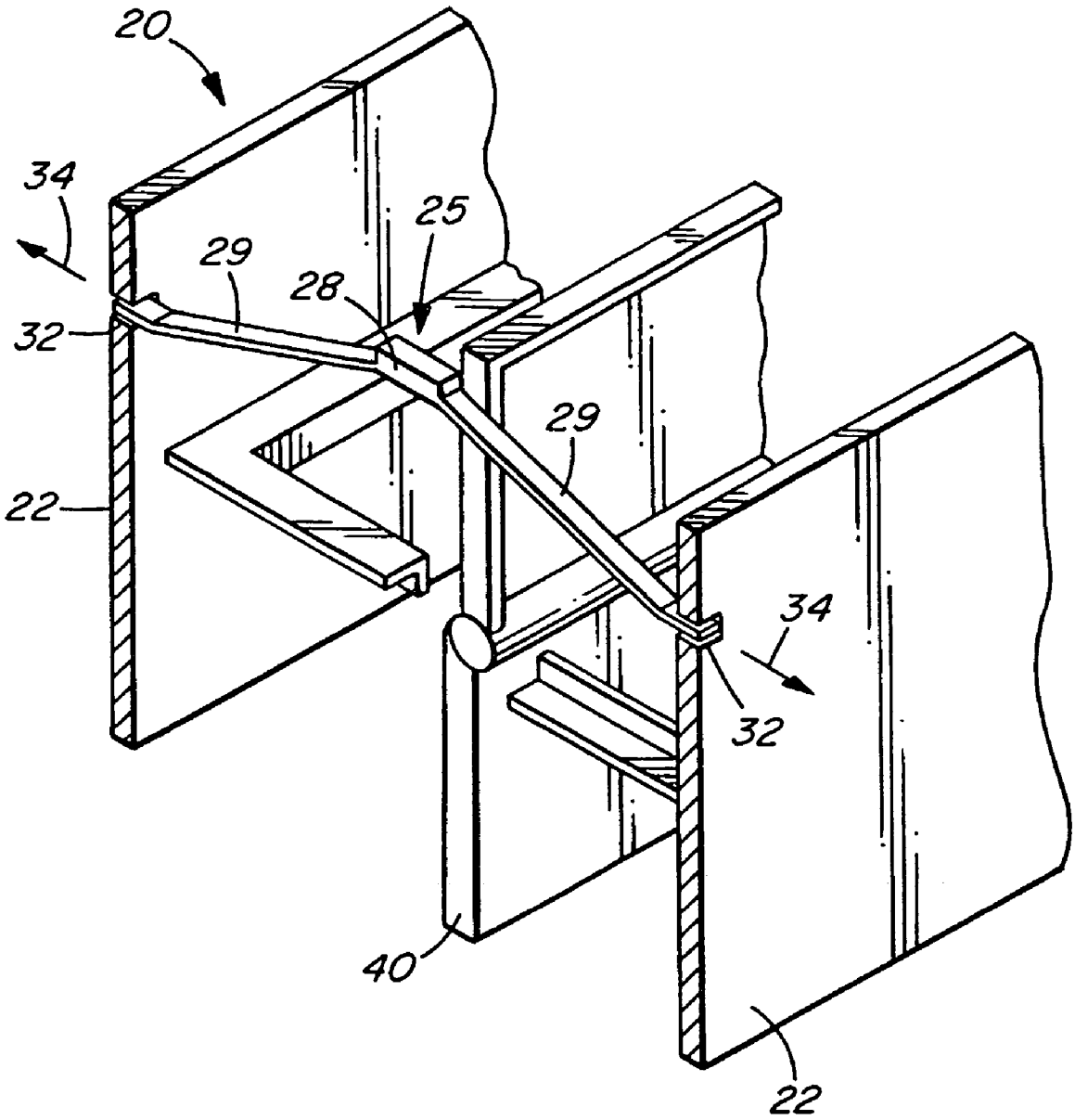
FIG. 3*a* is a detail view of a locking system for holding the register unit in place within a duct port.

FIGS. 2, 3 and 3*a* are detail views of a particular embodiment of a heat register unit 20. The register 20 includes side walls 22 adapted to be received in port 8 of the duct system. Preferably, each register unit 20 is removably insertable into port 8 to permit easy removal of the unit for periodic cleaning and maintenance. FIG. 3*a* shows a locking arrangement 25 for releasably locking the register unit within port 8 in the form of an elongate member having a central body 28 and flexible arms 29 extending downwardly and outwardly from either side of the central body. The distal ends 30 of arms 29 fit into slots 32 in side walls 22. Pressing down on central body 28 moves the body downwardly and causes the ends 30 of arms 29 to move outwardly as shown by arrows 34. Arm ends 30 are adapted to engage in slots formed in the walls of port 8 to releasably lock the register unit in place. Locking arrangement 25 is preferably formed from a resilient plastic. Other schemes for retaining the register unit in place within port 8 are possible. For example, the register unit may be formed with an upper flange with openings therethrough to accept fasteners (nails, screws) to retain the register unit within port 8. A cam locking arrangement to hold the register unit in place within port 8 is also possible.

Referring back to FIGS. 2 and 3, the illustrated heat register unit 20 includes a valve arrangement in the form of at least one plate 40 pivotally mounted between a pair of opposed side walls 22 of the register unit for pivoting about axis 42. As best shown in FIG. 3, plate 40 is pivotable about axis 42 between closed position 44 in which the plate completely blocks the flow of air through the passage 45 defined between side walls 22, and open position 46 (shown by dashed lines) in which the plate is rotated through 90 degrees (as indicated by arrow 47) to be generally parallel to the air flow through passage 45. Intermediate angular positions of plate 40 permit intermediate air flows through passage 45, however, the plate preferably operates on an on/off control scheme moving between just the open and closed positions.

Preferably, sealing means are provided to seal the edges of the plate when in the closed position. In the illustrated arrangement, the sealing means comprise lipped flanges 48 formed on the side walls of the register unit and an upstanding lip 49 formed about the perimeter of the plate. Flanges 48 and lips 49 are positioned and dimensioned to interlock when plate 40 is rotated to closed position 44 to effectively seal passage 45 for air flow. In the illustrated arrangement, a single pivoting plate 40 is shown. It will be readily apparent to a person of ordinary skill in the art that alternative arrangements are possible. For example, a plurality of pivoting plates or sliding plates linked for coordinated pivoting can also be used.

Opening and closing of the register unit, involving movement of plate 40 between the open and closed positions in the present example, is controlled by an actuator unit associated with register unit 20. FIGS. 2 and 3 show a preferred actuator unit 50 in the form of a vacuum actuator commonly referred to as a dashpot 51. Dashpot 51 is mounted to a side wall 22 and connected to a line 97 that communicates with a central source of vacuum. Within sealed dashpot housing 52, there is a flexible diaphragm 55 that is movable by varying the pressure within housing 52. Diaphragm 55 supports an articulated linkage 56 that connects dashpot 51 to plate 40. Movement of diaphragm 55 moves linkage 56 to cause pivoting of plate 40 between the open and closed positions.

Movement of diaphragm 55 can be controlled by varying the pressure in housing 52 via line 97. Preferably, dashpot 51 includes a biasing spring 57 that acts to bias the diaphragm to a default closed position of plate 40. Negative pressure (vacuum) is applied via line 97 to move diaphragm 55 against the spring force to move the plate to the open position as will be described in more detail below.

Figure 4:
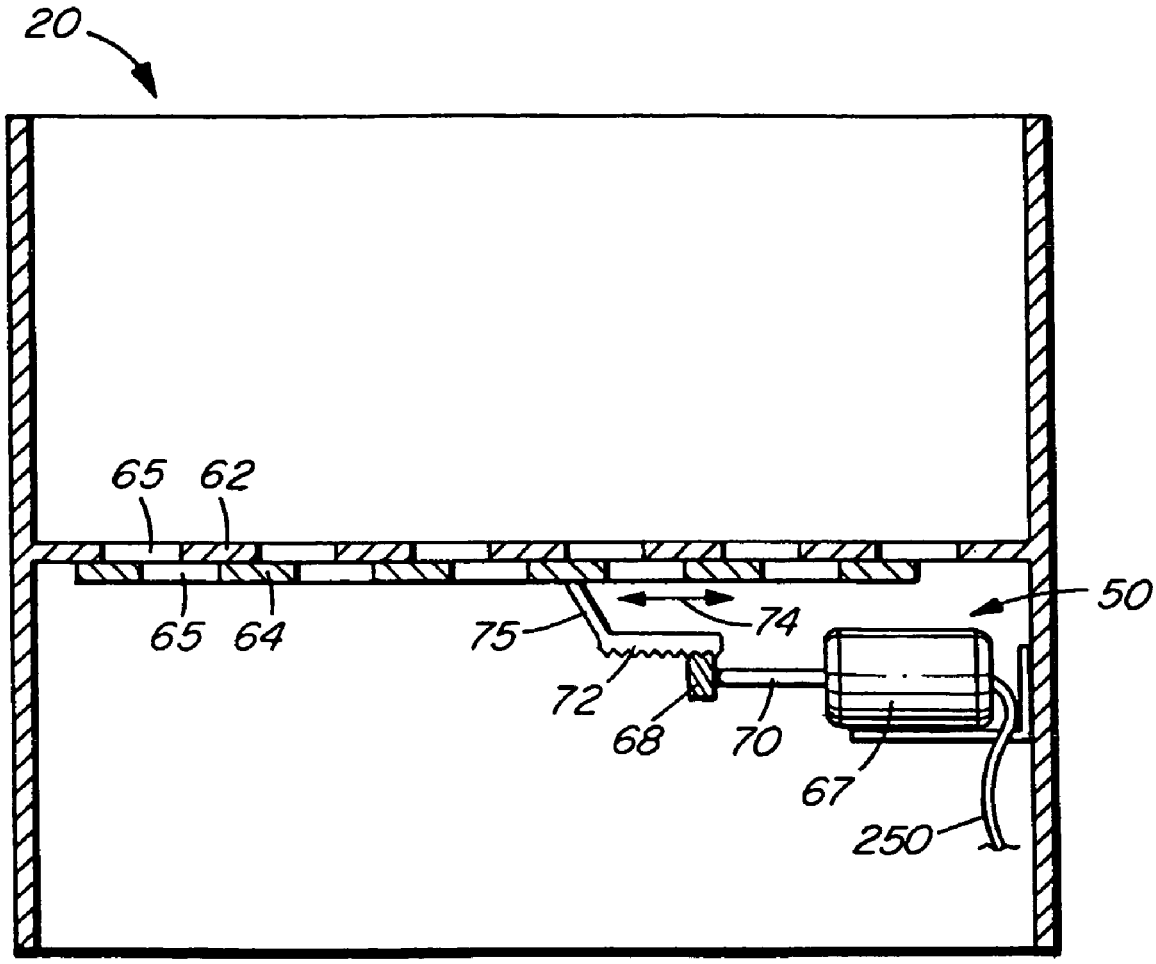
FIG. 4 is a detail schematic view of an alternative electric motor actuator for use with an alternative valve means that include sliding plates.

FIG. 4 illustrates a further example of a register unit 20 with an alternative valve system and actuator arrangement. Instead of a pivoting plate, the register unit of FIG. 4 is formed with first and second sets 62,64 of vanes defining openings 65 between the vanes. The first and second sets of vanes are movable with respect to each other by the operation of actuator unit 50 to align or misalign openings 65. When the openings are fully aligned, the register unit 20 is configured in the open position. When the openings are fully misaligned, the register unit 20 is configured in the closed position. Preferably, one of the sets of vanes is fixed and the second set is movable by actuator unit 50. In FIG. 4, the first set 62 of vanes is fixed and formed between the side walls of the register unit and the second set 64 of vanes are formed in a plate that is slidable with respect to the first set. The illustrated register unit of FIG. 4 has the openings partially misaligned while the movable set of vanes is moving between the open and closed positions.

The actuator unit 50 associated with the register unit 20 illustrated in FIG. 4 is an example of an alternative actuator to the dashpot 51 shown in FIGS. 2 and 3. Actuator unit 50 comprises an electric motor 67 to manipulate the vanes of the register. The electric motor 67 drives a bevel gear 68 via shaft 70. Rotation of gear 68 acts to move rack 72 laterally as indicated by arrow 74. Rack 72 is connected to the movable set of vanes 64 by link 75 to transmit the lateral motion of the rack to the vanes. Preferably, electric motor 67 is a one way unit that rotates shaft 70 in a first direction to open the register unit. An internal return spring operates to rotate shaft 70 in the opposite direction to close the register unit. Alternatively, electric motor can be a reversible unit that drives shaft 70 in both direction to open and close the register unit.

The actuator units 50 described above and illustrated in FIGS. 3 and 4 are only examples of possible units that can be used to move the valve system between the open and closed positions.

In the case of an electric motor as the actuator, alternative gear arrangements are possible from that illustrated in FIG. 4. For example, electric motor 67 can drive a straight cut gear to move rack 72 or a worm gear arrangement can be used. Instead of a rack, motor 67 can drive a wheel having a belt looped about the wheel with the ends of the belt attached to the movable set of vanes 64 such that rotation of the wheel shortens one side of the belt while lengthening the other to displace the vanes laterally.

Figure 5A:
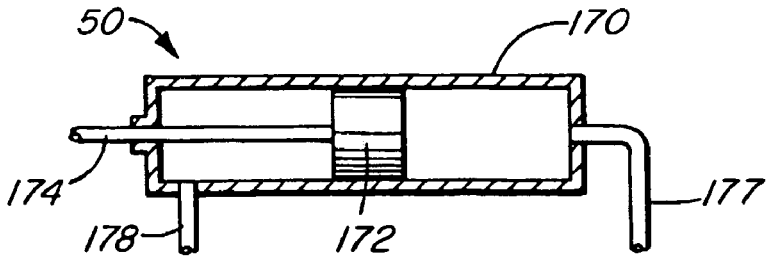
FIGS. 5*a* and 5*b* illustrate alternative cylinder actuators for use with the register units of the present invention.
Figure 5B:
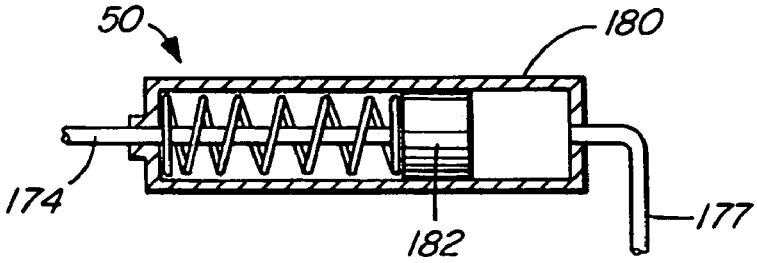

Instead of an electric motor, alternative actuator units 50 can include cylinder with piston units as shown in FIGS. 5*a* and 5*b* to manipulate the valve system between the open and closed positions. FIG. 5*a* shows a double acting or two way cylinder 170 with internal piston 172 that includes piston rod 174 that extends externally of the cylinder to control the valve system. Cylinder 170 requires two control lines 177 and 178. Line 177 provides air or liquid under pressure to drive piston 172 to the left while line 178 provides air or liquid to drive the piston in the opposite direction to the right. FIG. 5*b* shows a single acting cylinder 180 which includes a single control line 177 to deliver air or fluid under pressure to drive the piston 182 to the left. Spring 182 moves the piston to a default position at the right end of the cylinder.

The cylinder actuators shown in FIGS. 5*a* and 5*b* are preferably connected to a pneumatic or hydraulic source to move the piston.

Figure 6A:
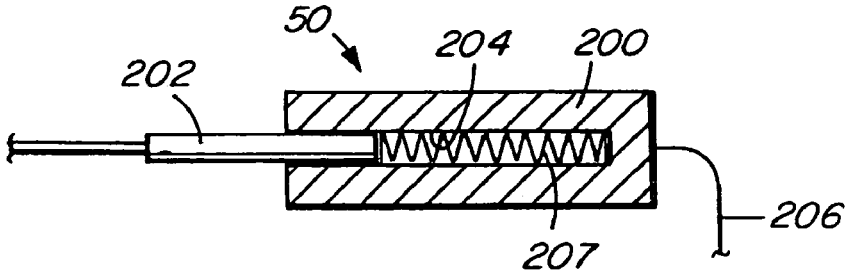
FIGS. 6*a* and 6*b* illustrate alternative solenoid actuators for use with the registers units of the present invention.
Figure 6B:
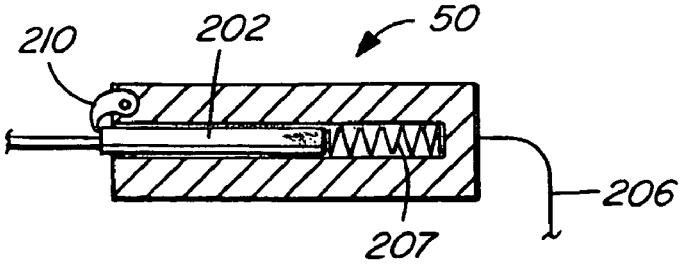

FIGS. 6*a* and 6*b* illustrate actuator units 50 in the form of solenoids. FIG. 6*a* shows a solenoid 200 with a solenoid plunger 202 movable within cavity 204 of the solenoid body. When an appropriate signal is received from control line 206, plunger 202 is retracted within cavity to control the valve system. Spring 207 normally biases the plunger outwardly of cavity 204 and a continuous control signal via line 206 is necessary to move plunger 202 against the force of the spring. FIG. 6*b* schematically illustrates an alternative solenoid arrangement in which a ratchet 210 maintains the position of plunger 202 until a signal is sent via control line 206. A single control signal is necessary to move plunger 202 inwardly against spring 207 into cavity 204 whereupon the plunger is held in place by ratchet mechanism 210. A subsequent signal allows for the plunger to be released from cavity 204. The solenoid of FIG. 6*b* operates in much the same manner as a retractable pen where a first push on a control knob by a user extends and locks the writing point for use and a second push retracts locks the writing head within the pen body.

Referring to FIG. 1, control of the position of the valve system between the open and closed positions in individual register units 20 is achieved by a central control means 80 remote from the register units. Central control means 80 interfaces with furnace 4 and temperature sensing means in the form of thermostats 82 in each air delivery zone or room 16. The central control means 80 communicates with the individual actuator units via a communication system that preferably extends through the existing duct work 6 of the building for ease of retrofitting the system of the present invention into an existing building. Thermostats 82 in each zone 16 permit a desired temperature to be set. The desired temperature is then communicated to the central control means 80 for activation of the register unit 20 associated with the zone in which the thermostat is located.

In keeping with the retrofittable nature of the system of the present invention, it is preferable that each thermostat 82 communicates via wireless transmitters to an appropriate wireless receiver at the central control means 80 to avoid the need to install wiring communicating the thermostats with central control means 80. It is also possible to use transmitter/receivers that are pluggable into conventional power sockets (or otherwise connectable into the wiring) to communicate over the existing wires of the building electrical wiring system. For example, a transmitter/receiver unit for use over power lines is manufactured by X10 Wireless Technology, Inc under the trademark Powerhouse. In new construction, where there is ready access to the interior of walls and floors under construction, dedicated wiring between the thermostats 82 and the central control means 80 can be used.

Figure 7:
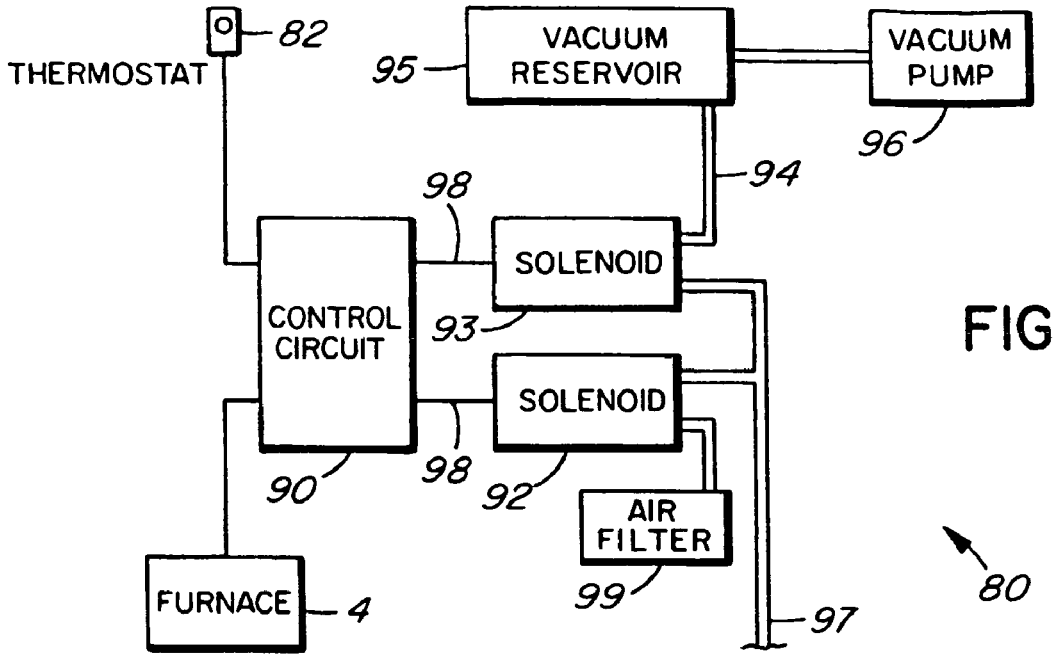
FIG. 7 is a flowchart of a control scheme according to the present invention for each thermostat and each zone based on a preferred embodiment using vacuum control of dashpot actuators.

In a preferred embodiment which relies on vacuum control of the system of the present invention in conjunction with dashpot actuators at the register units, each zone 16 is controlled via a control scheme illustrated in FIG. 7. Each zone includes an associated control circuit 90 at central control means 80 that receives signals (via wireless or over wires) from the thermostat 82 within the zone. The control circuit also communicates with furnace control circuit of furnace 4. Control circuit 90 can be either a solid state or a relay circuit and controls a pair of solenoids 92, 93 via lines 98. Solenoid 93 is connected via air line 94 to a vacuum reservoir 95. A vacuum pump 96 controlled in a conventional manner operates periodically to maintain the vacuum in reservoir 95. Solenoids 92 and 93 are connected via common air line 97 to the actuator unit/s 50 associated with the zone 16 controlled by thermostat 82. Solenoid 92 is also connected via air filter 99 to atmosphere. When a signal is received from thermostat 82 to raise the temperature in the zone, control circuit 90 initially sends a signal to the furnace control circuit to turn on the furnace to begin generating heat. After a delay to allow the furnace to heat up, the furnace fan blower motor is started to begin delivering heated air through the duct system 16. Control circuit 90 also activates solenoid 93 to open line 97 to the vacuum source 95 so that a lowered pressure is created in line 97. Solenoid 93 effectively acts as an "on" switch to open the valve at the register to admit heated air to the zone. Specifically, with reference to FIG. 3, when a negative pressure is created in line 97, dashpot 51 at the register unit 20 at the other end of the line is activated to move plate 40 from the default closed position 44 to the default open position 46 to allow the heated air being blown through the duct system into the zone.

In the case of multiple register units 20 being controlled by a single thermostat, each register unit is connected to a common line 97 such that the dashpot actuators all received the same vacuum signal.

When the desired temperature is reached in the zone, thermostat 82 sends a signal to control circuit 90 to activate solenoid 93 to close line 97 to the vacuum source. At the same time, solenoid 92 is activated as an "off" switch to open line 97 for a pre-determined period to introduce air into line 97 through filter 99 and normalize the pressure in the line. At the register unit, dashpot 51 returns plate 40 to the default closed position through the action of spring 57.

In the preferred arrangement discussed above, "on" solenoid 93 is activated for the entire time that the register unit is open to ensure that vacuum is maintained in line 97. Alternatively, "on" solenoid 93 can be activated for an initial predetermined period to generate a reduced pressure in line 97 to open the register unit. Solenoid 93 can then be deactivated with line 97 maintaining its reduced pressure to keep the register unit open. This arrangement relies on line 97 being well sealed to avoid leaks that would gradually normalize the pressure in the line to close the register unit.

Instead of an "off" solenoid 92, it is possible to rely on other techniques to normalize the pressure in line 97. For example, air line 97 can be made intentionally "leaky" such that air pressure in the line will tend to return to atmospheric pressure whenever the line is not directly communicated via "on" solenoid 93 to vacuum source 95. A drawback of this approach is that vacuum pump 96 will have to operate more frequently to ensure that vacuum source 95 is maintained at the required reduced pressure to compensate for leakage which occurs while line 97 is connected to the vacuum source.

Figure 8:
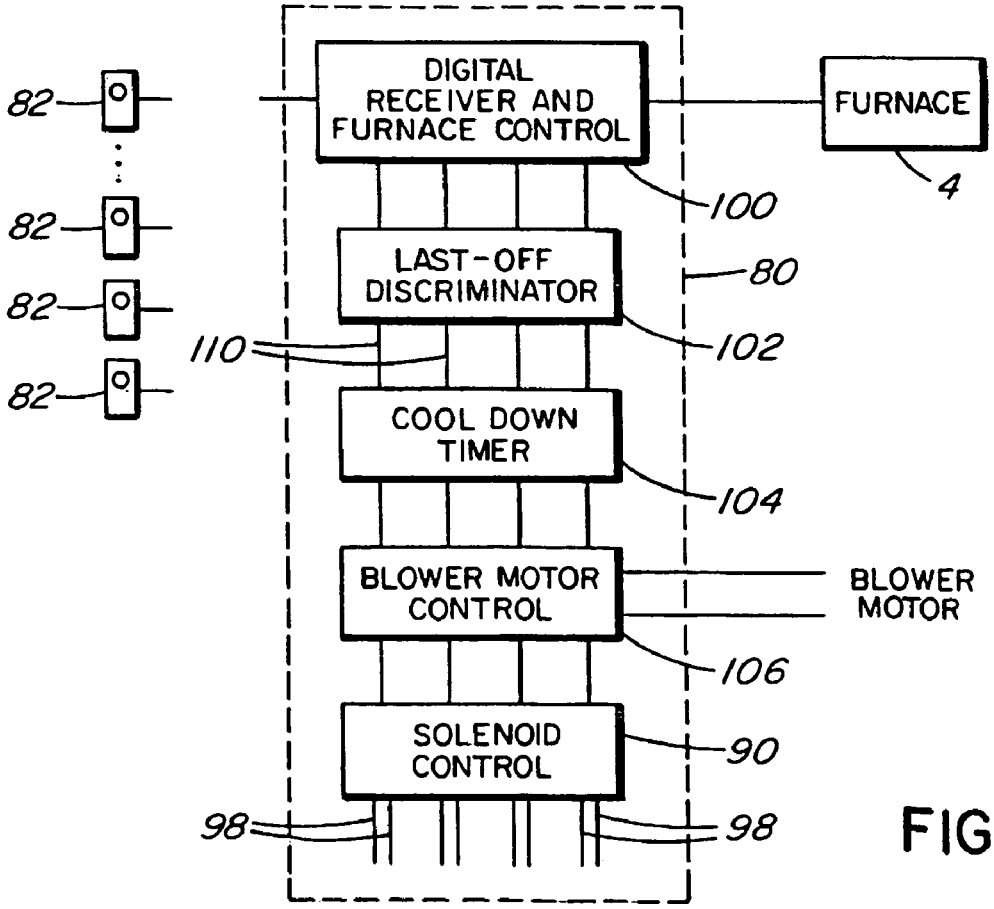
FIG. 8 is a schematic view showing the interface between the inventive system with multiple thermostats and zones and the furnace control system.

The above discussion addresses the operation of a single thermostat 82 controlling a single zone 16. While the principle of operation is the same for each zone, when multiple zones are being controlled additional control considerations are necessary. FIG. 8 illustrates a central control system 80 for co-ordinating the control of multiple zones 16. In the illustrated example, four separate zones are being controlled by four separate thermostats 82. The illustrated thermostats include transmitters that communicate wirelessly with a "gang" digital receiver and furnace control 100. Communication via dedicated wires or through the existing wiring system is also possible as discussed above. Each thermostat communicates via a separate channel so that each zone operates essentially independently of other zones.

Typically, in a heating application, when the thermostat tells the furnace to shut down, only the burner or heating unit shuts down immediately. The blower fan continues to pass air through the heat exchanger within the furnace, for a short period set in a furnace cool down timer, to dissipate the heat build-up, in a process known as a cool down cycle. To take this into account, last-off discriminator circuit 102 is provided to check each time a register unit shuts down to ensure that it is not the last register unit open in the system. If no other zones require heated air, heat generation at furnace 4 is stopped, but the last register unit is prevented from closing immediately as this would result in excess air pressure in the system that could damage the duct work. Cool down timer 104 is set to a time longer than the time programmed for the conventional furnace cool down cycle to ensure that the last open register is maintained open until the blower fan finishes operating. The cool down timer 104 thereby ensures that air generated by the blower fan can always exhaust through an open register in the duct system. After cool down timer 104 expires, solenoid control 90 is allowed to shut down the last open register by appropriate activation of the solenoids 92, 93 associated with the open register unit. If during the cool down cycle of furnace 4, one or more zones call for heat via a new signal from a thermostat, then the cool down cycles of the furnace and timer 104 are cancelled, furnace 4 is activated to generate heat and blower motor control 106 keeps the blower fan operating to circulate heated air to the duct system for delivery to the newly opened register unit. The register unit that was previously being held open for the cool down cycle can be closed immediately.

In addition, a fan blower motor speed control device can be used and programmed to reduce the air flow from the furnace when fewer registers are open. Such a device would typically be a silicon control rectifier (SCR) type AC motor speed control. The device would be programmed at the time of installation if variable speed of the fan blower motor is to be used.

As illustrated in FIG. 8, each zone has a separate communication line or channel 110 for transmitting control signals between the component control circuits. Solenoid control circuit 90 includes two lines 98 per zone for control of the "on", "off" solenoids.

While the foregoing discussion relates specifically to operation of the system of the present invention in conjunction with a furnace delivering heated air, it will be apparent to a person skilled in the art that operation of an air conditioning unit is analogous.

Figure 9:
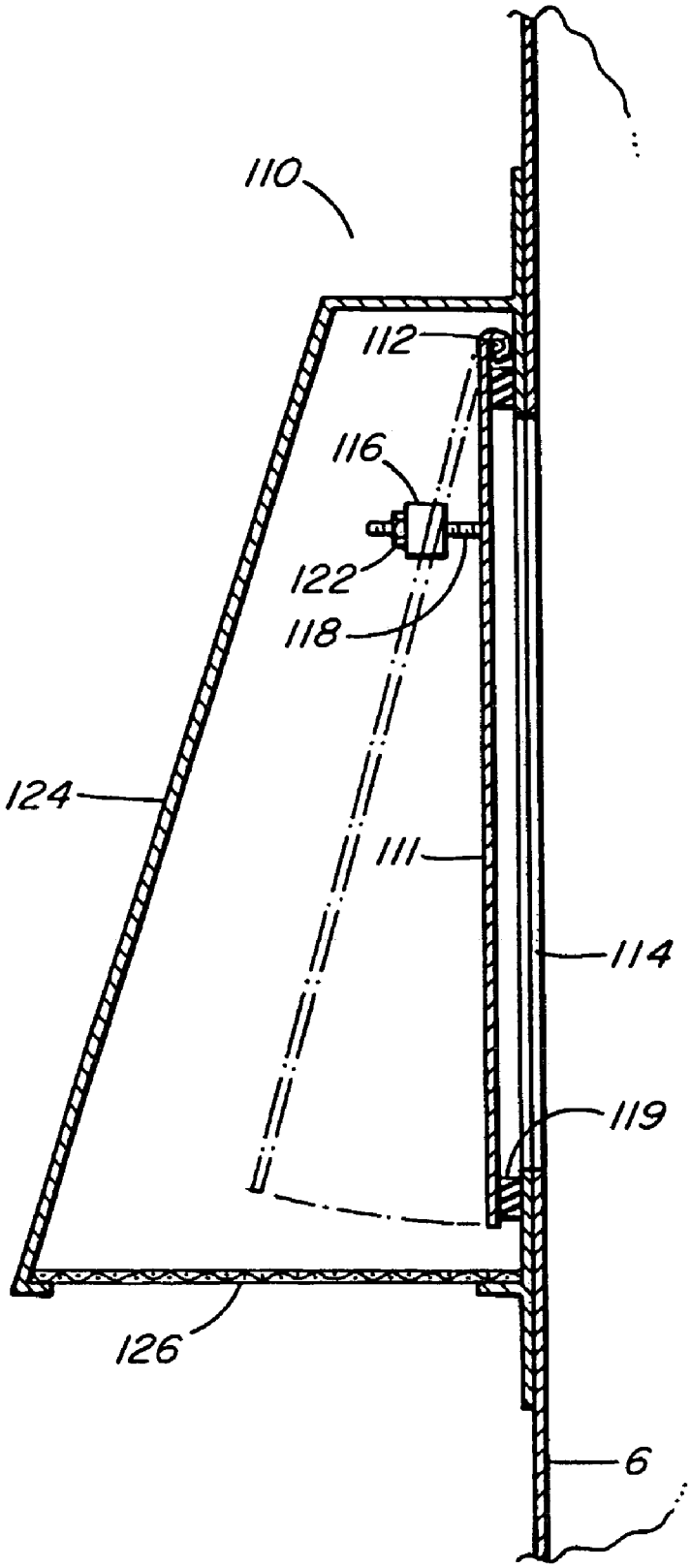
FIG. 9 is a detail view of a pressure relief valve that can be used in the duct system to prevent over pressures developing.

To avoid potential overpressures in the duct system, it is also possible to install a pressure relief valve 110 as shown in FIG. 9. The valve comprises a weighted flap 111 mounted via hinge 112 over an opening 114 formed in a side wall of duct work 6 on the main furnace output plenum. Weight 116 is positioned on threaded post 118 to maintain flap 111 in a default closed position by gravity against gasket 119 to seal the duct. Weight 16 can be rotated to adjust its position on post 118 to adjust the force necessary to open the pressure relief valve. The weight can be adjusted to set the over pressure within duct 6 at which flap 111 will pivot open to relieve excess pressure. A lock nut 122 is used to maintain weight 116 at the desired position. Preferably, a covering 124 sits over the valve and opening 114 with a lower screen 126 to prevent objects from getting into the duct work. Alternative methods of controlling the opening of flap 111 are possible such as a spring.

Figure 10:
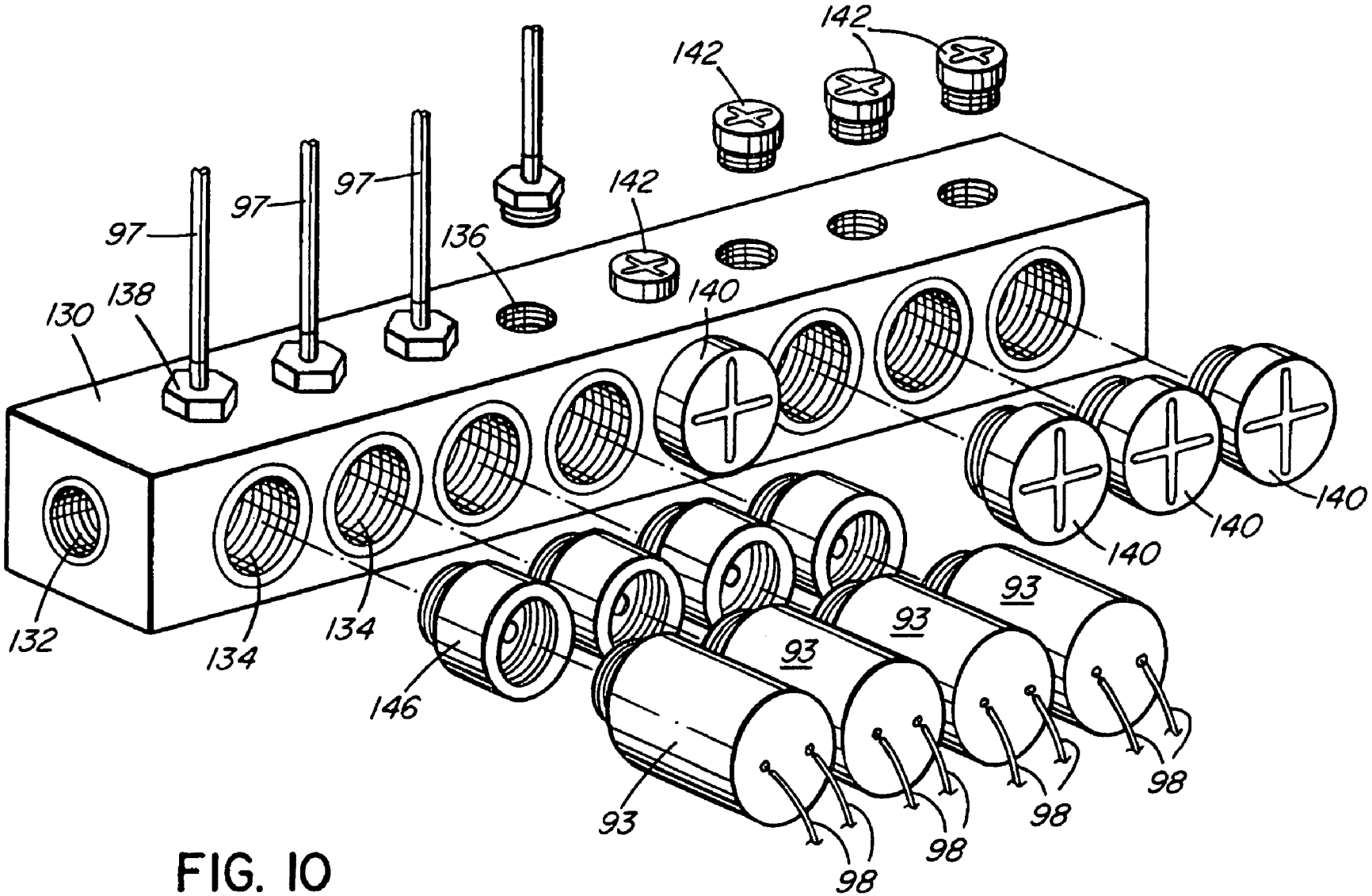
FIG. 10 is a detail view of a vacuum manifold used with the vacuum control embodiment of the present invention.

To simplify the operation and co-ordination of solenoids 92, 93 associated with each control zone 16, the present invention preferably relies on a manifold arrangement as shown in FIG. 10. The "on" solenoids 93 for all zones are grouped together in an "on" manifold 130 and the "off" solenoids 92 for all zones are grouped together in an similar off manifold (not shown). Each manifold is formed with a central passage 132 running end to end that communicates with a plurality of pairs of side ports 134 and top ports 136. Manifold 130 is modular in design. In the illustrated embodiment, up to eight solenoids 92,93 can be threaded into the side ports 134 to define 8 zones. Similarly, up to eight air lines 97 to control up to eight register units are adapted to be connected to mounting points 138 which fit into top ports 136. Sealing caps 140 and 142 are threadably received in unused side ports 134 and top ports 136, respectively. Solenoids 92, 93 are preferably retained in adapters 146 that are threadably received in side ports 134 to seal the solenoids to the manifold.

Figure 11A:
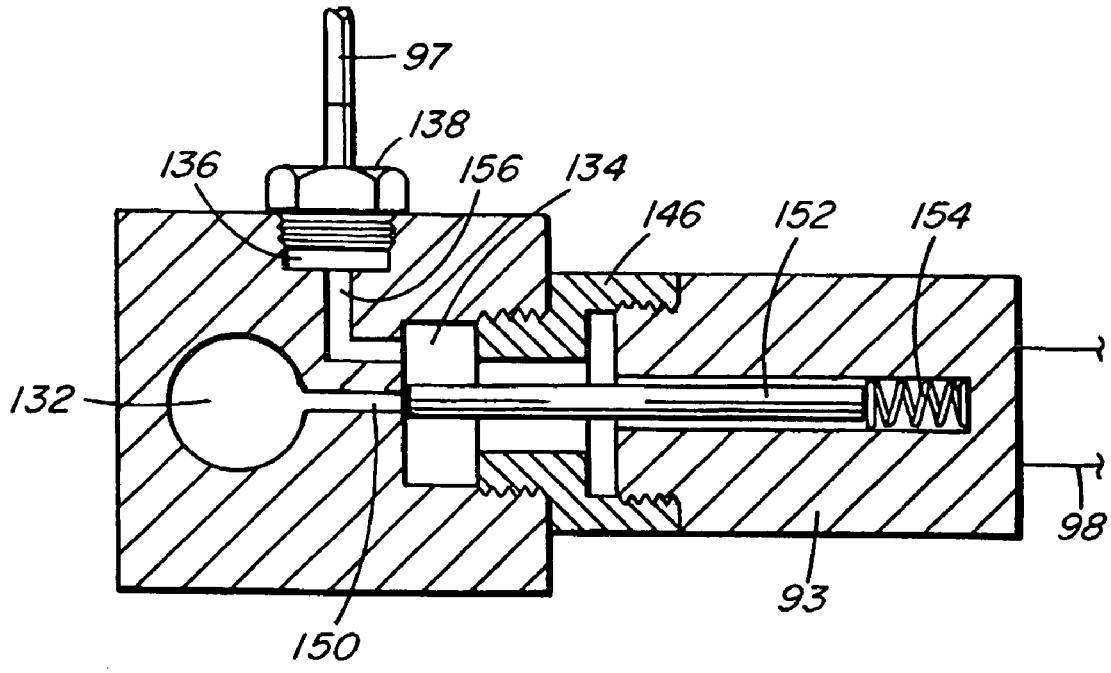
FIGS. 11*a* and 11*b* are cross-sections through the vacuum manifold showing the operation of the solenoids.
Figure 11B:
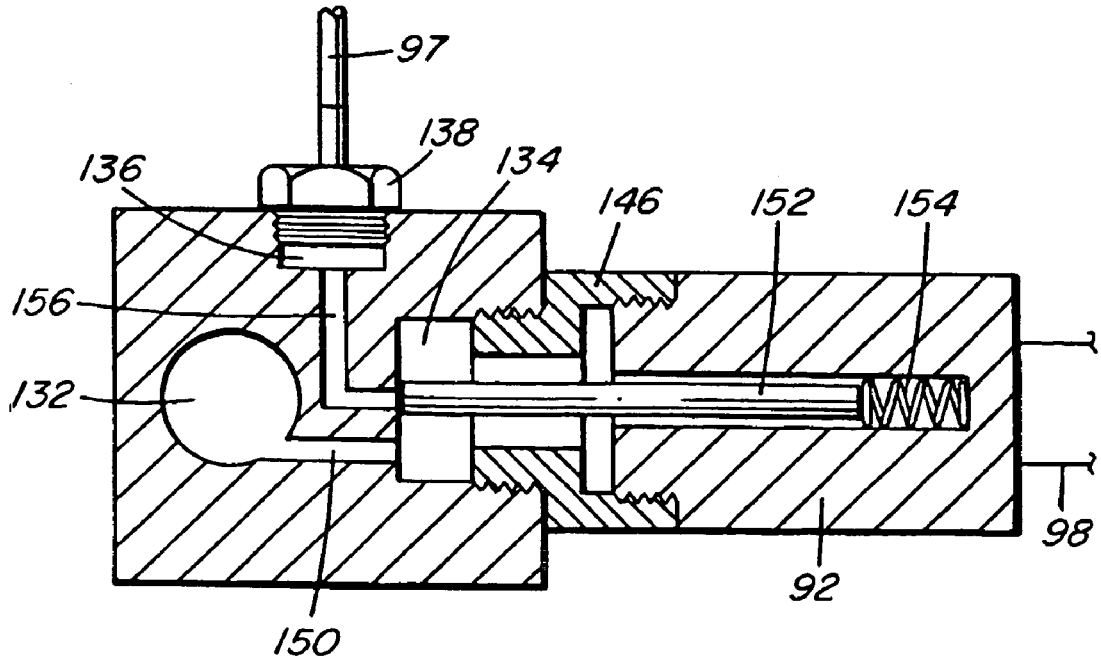

FIGS. 11*a* and 11*b* are cross-sections through a pair of side and top ports 134, 136. FIG. 11*a* shows the interconnection between central passage 132 and ports 134 and 136 in a manifold used with "on" solenoids93 while FIG. 11*b* shows the interconnection between the various ports in a manifold used with "off" solenoids.

In FIG. 11*a*, central passage 132 communicates with vacuum reservoir 95 to maintain the passage at a reduced air pressure. Central passage 132 communicates with side port 134 via internal passage 150. Top port 136 communicates with associated side port 134 via internal passage 156. Solenoid 93 includes movable piston 152 that is biased by spring 154 to engage and seal passage 150 by default. Passage 150 is formed centrally in inner wall of side port 134 to align with piston 150. When solenoid 93 is activated by a signal from control line 98, piston 152 is retracted into the interior of solenoid 93 so that passage 150 is opened and the reduced pressure of passage 132 is communicated to top port 136 via internal passage 156, then to air line 97 and the actuator of the connected register unit.

In the manifold of FIG. 11*b*, central passage 132 communicates via filter 99 (FIG. 7) with the atmosphere. In this manifold, internal passage 156 is formed centrally in inner wall of side port 134 to align with piston 150 of "Off" solenoid 92. Therefore, when movable piston 152 is moved away from its default sealing position over passage 156 by activation of solenoid 92, air line 97 is communicated with atmosphere to normalize pressure in the line.

The foregoing discussion has been based on the preferred vacuum control system with dashpot actuators illustrated in FIGS. 3, 7 and 8. If alternative actuators are used, changes in the control system may be necessary. For example, if electric motor actuators as shown in FIG. 4 are used, a vacuum source and vacuum manifold arrangement are unnecessary. Instead of vacuum control lines 97, wires 250 to provide electrical power extend through the air distribution duct work to interconnect the electric motors 67 to a "gang" relay or solid state control circuit which activates the motors in response to signals from thermostats 82. Such an arrangement would also be used for the solenoid actuators illustrated in FIGS. 6*a* and 6*b*. In the case of the cylinder actuators (pneumatic or hydraulic) as shown in FIGS. 5*a*, 5*b*, appropriate pneumatic or hydraulic control lines 177 would extend through the duct system to communicate with a hydraulic fluid or pneumatic pressure source. A solenoid controlled manifold system as illustrated in FIGS. 10 and 11 would still preferably be used to control the distribution of pneumatic pressure or hydraulic fluid. In the case of the double acting cylinder shown in FIG. 5*a*, an additional hydraulic or pneumatic line 178 would have to extend through the air duct system between the central control means 80 and the actuator 50.

Although the present invention has been described in some detail by way of example for purposes of clarity and understanding, it will be apparent that certain changes and modifications may be practised within the scope of the appended claims.

I claim:

1. Apparatus for controlling the delivery of air in a forced air distribution system having a source of air under pressure, comprising:

at least one duct defining a common duct system to deliver the air and at least two outlet ports in the duct system, each said outlet port in fluid communication with a corresponding air delivery zone;

a vent unit associated with each said outlet port movable between an open position to admit air to the corresponding zone and a closed position to block air from the corresponding zone;

a central control system remote from each said vent unit;

a temperature sensor in each said air delivery zone in communication with the central control system; and an actuator unit associated with each said vent unit, each said actuator unit operable to configure said associated vent unit into said open position or into said closed position in response to communication from said central control system.

2. Apparatus as claimed in claim 1 including a communication system for allowing the actuator unit to communicate with the central control system, the communication system extending through the duct system.

3. Apparatus as claimed in claim 1 in which the vent unit comprises:

a register unit insertable into each said outlet port; and a valve unit configurable to define the open and closed positions of the vent unit to control the flow of air through the register unit.

4. Apparatus as claimed in claim 3 in which the register unit is removably insertable into each said outlet port.

5. Apparatus as claimed in claim 3 in which the actuator unit comprises an electric motor to manipulate the valve unit.

6. Apparatus as claimed in claim 5 in which the electric motor is reversible to configure the valve unit between the open and closed positions.

7. Apparatus as claimed in claim 5 in which the electric motor is a one way unit to configure the valve unit between one of the open and closed positions with a spring return to configure the valve unit between the other of the open and closed positions.

8. Apparatus as claimed in claim 3 in which the actuator unit comprises a cylinder actuator to manipulate the valve unit.

9. Apparatus as claimed in claim 8 in which the cylinder actuator is a double acting cylinder to configure the valve unit between the open and closed positions.

10. Apparatus as claimed in claim 8 in which the cylinder actuator is a single acting cylinder to move the valve unit between one of the open and closed positions with a spring return to configure the valve means between the other of the open and closed positions.

11. Apparatus as claimed in claim 8 in which the cylinder actuator is a pneumatic cylinder.

12. Apparatus as claimed in claim 8 in which the cylinder actuator is a hydraulic cylinder.

13. Apparatus as claimed in claim 3 in which the actuator comprises a solenoid actuator having a movable plunger to manipulate the valve unit.

14. Apparatus as claimed in claim 13 in which the solenoid actuator includes a ratchet mechanism to releasably lock the plunger in position.

15. Apparatus as claimed in claim 3 in which the actuator unit comprises a vacuum actuator.

16. Apparatus as claimed in claim 3 in which the valve unit comprises first and second sets of vanes defining openings between the vanes, the first and second sets being movable with respect to each other by the actuator unit to align the openings to configure the vent unit in the open position and to misalign the openings to configure the vent unit in the closed position.

17. Apparatus as claimed in claim 16 in which the first set of vanes is fixed and the second set is movable.

18. Apparatus as claimed in claim 3 in which the valve unit comprises at least one plate pivotally mounted to the register, the at least one plate being pivotable by the actuator unit between a first position to configure the vent unit in the open position and a second position to configure the vent unit in the closed position.

19. Apparatus as claimed in claim 18 including co-operating seals on the plate and register that engage when the plate is pivoted to the second position.

20. Apparatus as claimed in claim 1 including an over pressure valve installable in each duct.

21. Apparatus as claimed in claim 1 in which the temperature sensor comprises a thermostat for transmitting the temperature to the central control system.

22. Apparatus as claimed in claim 21 in which the thermostat communicates with a wireless transmitter for transmitting the temperature to a wireless receiver at the central control system.

23. Apparatus as claimed in claim 21 in which the thermostat communicates with the central control system via electrical lines.

24. Apparatus as claimed in claim 1 in which the actuator unit comprises a vacuum actuator and the central control system controls the vacuum actuator by a vacuum line extending through the duct system.

25. Apparatus as claimed in claim 24 in which the central control system includes:

a vacuum source;

a switch to connect the vacuum line to or disconnect the vacuum line from the source of vacuum to operate the vacuum actuator.

26. Apparatus as claimed in claim 25 in which the switch comprises a solenoid having a plunger movable between a position to block the vacuum line to disconnect the actuator from the vacuum source and a position to open the vacuum line to connect the actuator to the vacuum source.

27. Apparatus as claimed in claim 25 including an additional switch to connect the vacuum line to atmospheric pressure on disconnection of the line from the source of vacuum in order to restore pressure in the vacuum line.

28. Apparatus as claimed in claim 25 in which the vacuum line is restored to atmospheric pressure by leakage.

29. Apparatus as claimed in claim 25 in which the central control system controls a plurality of actuators via a manifold having a central passage connected to the vacuum source, a plurality of ports connected by vacuum lines to the plurality of actuators, and a switch associated with each of said plurality of ports for opening or closing a corresponding one of said plurality of ports, respectively, for communication with the central passage to connect the vacuum line to the vacuum source.

30. Apparatus as claimed in claim 29 in which the switch comprise a solenoid which acts to open or close the corresponding one of said plurality of ports, respectively, for communication of the vacuum line with the central passage and the vacuum source.

31. Apparatus for controlling the delivery of air in a forced air distribution system having a source of air under pressure, comprising, in combination:

at least one duct defining a common duct system to deliver the air and at least two outlet ports in the duct system, each said outlet port in fluid communication with a corresponding air delivery zone;

a register unit having a valve associated with each said outlet port, the valve being movable between an open position to admit air to the zone and a closed position to block air from the zone;

an actuator unit associated with each said register unit, each said actuator unit operable to configure said valve of said associated register unit into said open position or into said closed position;

a central control system remote from the register units for controlling the actuator units; and a thermostat in each air delivery zone for setting a desired temperature in each of the air delivery zones, the thermostats being in communication with the central control system, and the central control system being operable to control the actuator units and the source of air under pressure such that the valves admits air to the corresponding zones and block air from the corresponding zones, in order to achieve said desired temperatures.

32. Apparatus for controlling the delivery of air in a forced air distribution system having a source of air under pressure, comprising:

at least one duct defining a common duct system to deliver the air;

at least two outlet ports defined in the duct system, each of said outlet ports in fluid communication with a corresponding air delivery zone;

a vent unit associated with each of said outlet ports movable between an open position to admit air to each said zone, respectively, and a closed position to block air from each said zone, respectively;

an actuator unit associated with each said vent unit, each said actuator unit operable to configure said associated vent unit into said open position or into said closed position;

a central control system remote from the vent units for controlling the actuator units; and a temperature sensor in each said air delivery zone in communication with the central control system to control operation of the actuator units and the source of air under pressure.

* * * * *